US011015391B1

(12) United States Patent
Kanaan

(10) Patent No.: US 11,015,391 B1
(45) Date of Patent: May 25, 2021

(54) LADDER SEAT ASSEMBLY

(71) Applicant: Ayed Kanaan, North Olmstead, OH (US)

(72) Inventor: Ayed Kanaan, North Olmstead, OH (US)

( * ) Notice: Subject to any disclaimer, the term of this patent is extended or adjusted under 35 U.S.C. 154(b) by 0 days.

(21) Appl. No.: 16/796,283

(22) Filed: Feb. 20, 2020

(51) Int. Cl.

| | |
|---|---|
| ***E06C 7/16*** | (2006.01) |
| ***E04G 5/06*** | (2006.01) |
| ***A47C 1/00*** | (2006.01) |
| ***E06C 7/00*** | (2006.01) |
| ***A47C 15/00*** | (2006.01) |
| ***A47C 4/02*** | (2006.01) |

(52) U.S. Cl.
CPC ..... *E06C 7/16* (2013.01); *A47C 1/00* (2013.01); *A47C 4/022* (2013.01); *A47C 15/004* (2013.01); *E04G 5/065* (2013.01); *E06C 7/00* (2013.01)

(58) Field of Classification Search
CPC ... E06C 7/16; A47C 4/022; A45F 3/26; E04G 5/065
USPC ..... 297/195.11, 217.1, 217.7, 135, 174 R
See application file for complete search history.

(56) References Cited

U.S. PATENT DOCUMENTS

| | | | | | |
|---|---|---|---|---|---|
| 478,987 | A * | 7/1892 | Colby | A47B 83/02 | 297/142 |
| 1,236,960 | A * | 8/1917 | McMillan | E04H 12/24 | 248/219.1 |
| 1,489,982 | A * | 4/1924 | Dailey | A47C 9/022 | 297/142 |
| 2,339,647 | A * | 1/1944 | Meyer | A47C 9/022 | 4/637 |
| 2,536,572 | A * | 1/1951 | Sather, Jr. | B60N 2/40 | 248/573 |
| 2,662,716 | A * | 12/1953 | Lowrey | E06C 7/16 | 248/238 |
| 2,802,702 | A | 8/1957 | Rose | | |
| 2,818,310 | A | 12/1957 | Campbell | | |
| 2,871,067 | A | 1/1959 | Brogdon | | |
| D248,777 | S | 8/1978 | Spencer | | |
| 4,129,198 | A * | 12/1978 | Hunter | E04G 3/24 | 108/152 |
| 4,303,145 | A | 12/1981 | Vazquez | | |
| 4,730,697 | A | 3/1988 | Campbell | | |
| 6,109,392 | A | 8/2000 | Merrick | | |
| 8,250,992 | B2 | 8/2012 | Swgert | | |
| 9,834,988 | B1 | 12/2017 | Arduna | | |

(Continued)

FOREIGN PATENT DOCUMENTS

| | | | | |
|---|---|---|---|---|
| CA | 2476943 A1 * | 1/2006 | ..... | E06C 7/182 |
| CH | 586431 A * | 3/1978 | ..... | E06C 7/16 |

(Continued)

*Primary Examiner* — Robert Canfield

(57) ABSTRACT

A ladder seat assembly for assuming a seated position on a ladder includes a first bracket and a second bracket that are each positionable on a respective step of the ladder. A pole is coupled to and extends downwardly from the second bracket to engage the first bracket. A seat mount is positionable around the pole such that the seat mount is centrally positioned between the first bracket and the second bracket when each of the first bracket and the second bracket are positioned on the ladder. A seat unit is removably attachable to the seat mount wherein the seat unit is configured to have the user sit thereon while the user is on the ladder thereby enhancing comfort for the user.

11 Claims, 6 Drawing Sheets

(56) References Cited

U.S. PATENT DOCUMENTS

| | | | | |
|---|---|---|---|---|
| 2008/0106130 | A1* | 5/2008 | Carpenter | A47C 9/06<br>297/217.7 |
| 2016/0374472 | A1* | 12/2016 | Horn | A47C 9/06<br>297/344.21 |
| 2019/0231076 | A1* | 8/2019 | Christie | A47C 5/10 |

FOREIGN PATENT DOCUMENTS

| | | | | | |
|---|---|---|---|---|---|
| EP | 0236635 | | | 12/1986 | |
| EP | 0236635 | A2 | * | 9/1987 | E06C 7/16 |
| ES | 1142110 | U | * | 8/2015 | |
| FR | 35926 | E | * | 3/1930 | E06C 7/16 |
| GB | 2187783 | A | * | 9/1987 | E06C 7/16 |

* cited by examiner

LADDER SEAT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to seat devices and more particularly pertains to a new seat device for assuming a seated position on a ladder.

(2) Description of Related Art Including Information Disclosed Under 37 CFR 1.97 and 1.98

The prior art relates to seat devices. The prior art discloses a seat being mountable to steps on a ladder that can swing horizontally on the ladder. Additionally, the prior art discloses a ladder seat that is coupled between a pair of steps on a ladder and includes a mechanical lock for engaging the ladder. The prior art discloses a ladder seat that hooks onto a pair of steps on a ladder. The prior art also discloses a ladder seat that hooks onto a pair of steps on a ladder, and which also includes a pivotable seat. Additionally, the prior art discloses a variety of step extension devices that are mountable on a ladder for increasing the size of an available standing area compared to a step on the ladder.

BRIEF SUMMARY OF THE INVENTION

An embodiment of the disclosure meets the needs presented above by generally comprising a first bracket and a second bracket that are each positionable on a respective step of the ladder. A pole is coupled to and extends downwardly from the second bracket to engage the first bracket. A seat mount is positionable around the pole such that the seat mount is centrally positioned between the first bracket and the second bracket when each of the first bracket and the second bracket are positioned on the ladder. A seat unit is removably attachable to the seat mount wherein the seat unit is configured to have the user sit thereon while the user is on the ladder thereby enhancing comfort for the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
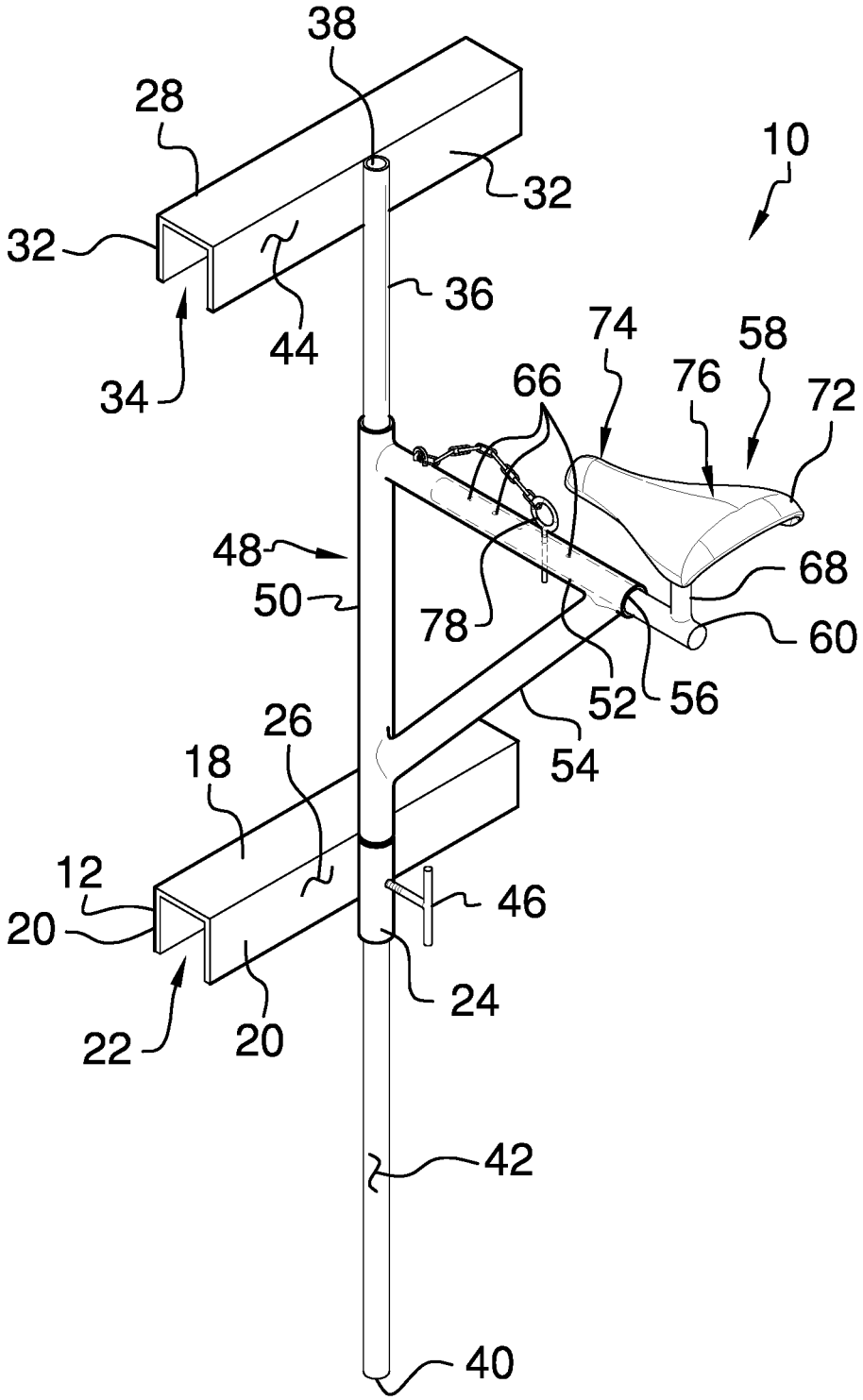
FIG. 1 is a perspective view of a ladder seat assembly according to an embodiment of the disclosure.
Figure 2:
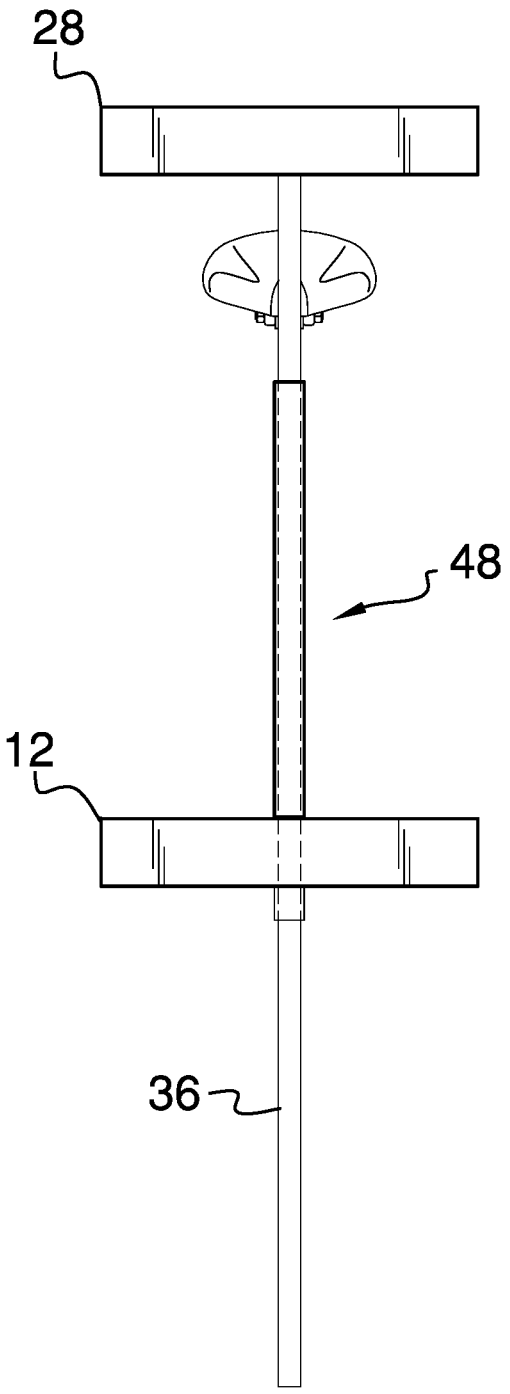
FIG. 2 is a front view of an embodiment of the disclosure.
Figure 3:
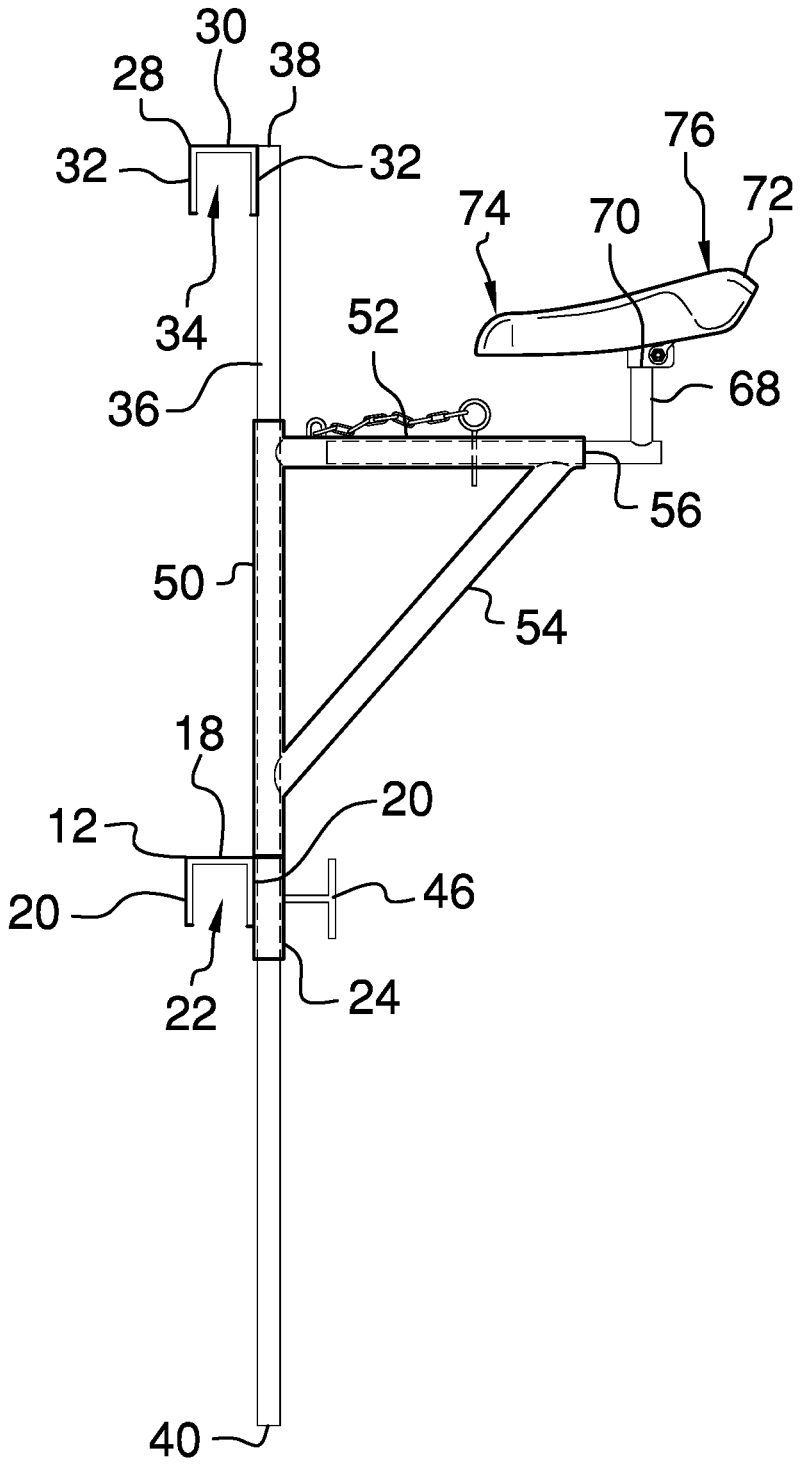
FIG. 3 is a left side view of an embodiment of the disclosure.
Figure 4:
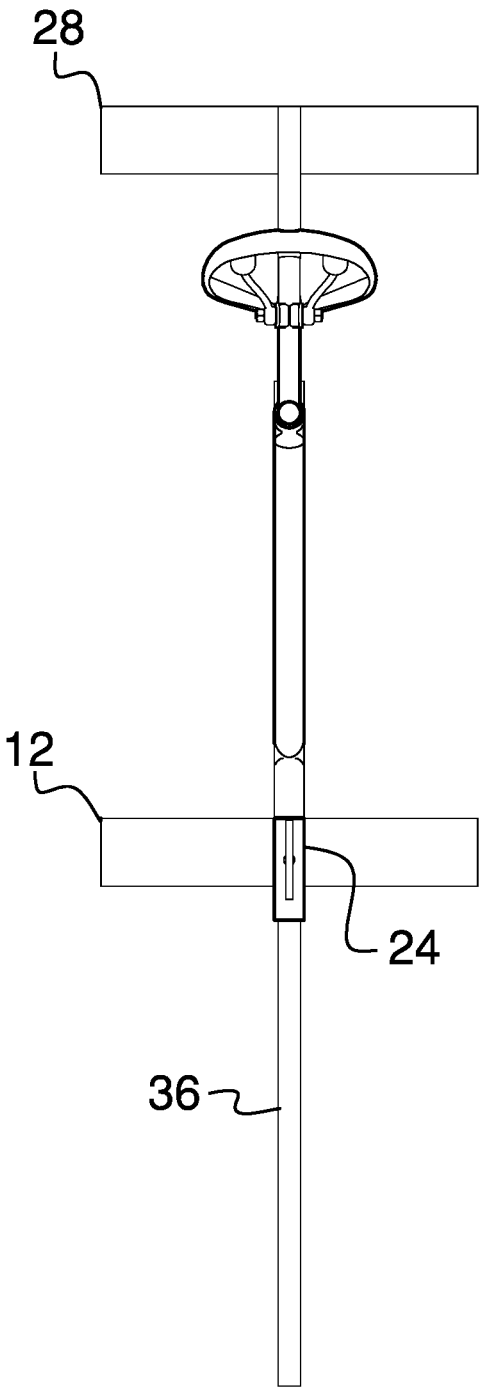
FIG. 4 is a back view of an embodiment of the disclosure.
Figure 5:
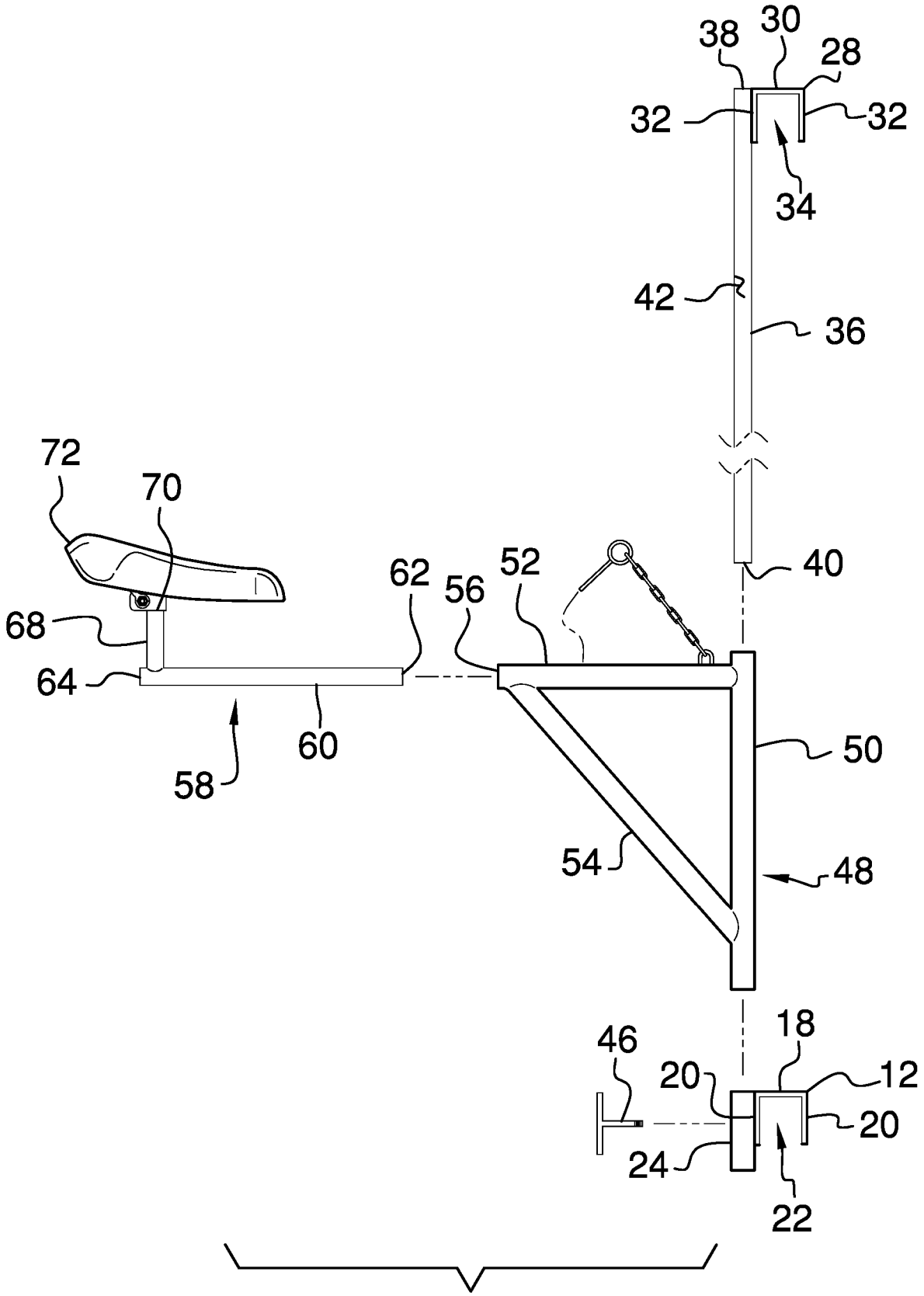
FIG. 5 is an exploded perspective view of an embodiment of the disclosure.
Figure 6:
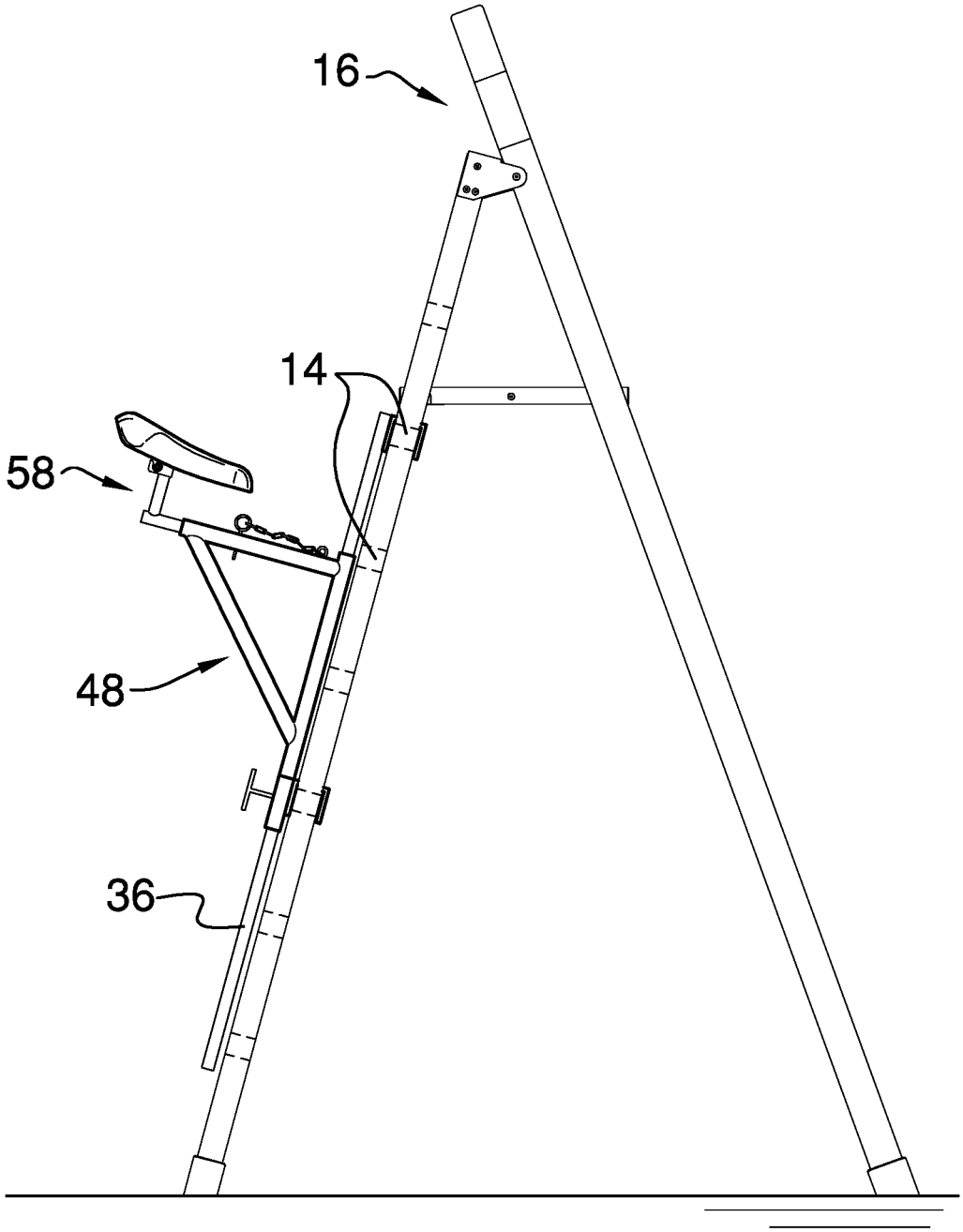
FIG. 6 is a perspective in-use view of an embodiment of the disclosure.

With reference now to the drawings, and in particular to FIGS. 1 through 6 thereof, a new seat device embodying the principles and concepts of an embodiment of the disclosure and generally designated by the reference numeral 10 will be described.

As best illustrated in FIGS. 1 through 6, the ladder seat assembly 10 generally comprises a first bracket 12 that is positionable on a respective step 14 of a ladder 16. The ladder 16 may be a step ladder, an extension ladder or any other type of ladder that a user can climb. The first bracket 12 has a central portion 18 extending between a pair of end portions 20. Each of the end portions 20 extends downwardly from the central portion 18 thereby defining a step space 22 between the end portions 20. The step space 22 insertably receives the respective step 14 having the central portion 18 resting on the respective step 14. A sleeve 24 is coupled to the first bracket 12 and the sleeve 24 is positioned on an outer surface 26 of a respective one of the end portions 20 of the first bracket 12. The sleeve 24 is centrally positioned on the respective end portion 20 and the sleeve 24 is oriented to extend along a vertical line when the first bracket 12 is positioned on the respective step 14.

A second bracket 28 is provided and the second bracket 28 is positionable on a respective step 14 of the ladder 16 that is spaced upwardly on the ladder 16 from the step 14 on which the first bracket 12 is positioned. The second bracket 28 has a central portion 30 extending between a pair of end portions 32. Each of the end portions 32 of the second bracket 28 extends downwardly from the central portion 30 of the second bracket 28 thereby defining a step space 34 between the end portions 32 of the second bracket 28. The step space 34 associated with the second bracket 28 insertably receives the respective step 14 on which the second bracket 28 is positioned and the central portion 30 of the second bracket 28 rests on the respective step 14 upon which the second bracket 28 is positioned.

A pole 36 is coupled to and extends downwardly from the second bracket 28. The pole 36 is extendable through the sleeve 24 when each of the first bracket 12 and the second bracket 28 are positioned on the respective steps 14 of the ladder 16. The pole 36 has a top end 38, a bottom end 40 and an outer surface 42 extending therebetween, and the outer surface 42 of the pole 36 is coupled to an outside surface 44 of a respective one of the end portions 32 of the second bracket 28. The top end 38 of the pole 36 is aligned with the central portion of the second bracket 28 and the pole 36 is centrally positioned on the second bracket 28. Additionally, the sleeve 24 insertably receives the bottom end 40 of the pole 36.

A fastener 46 is provided and the fastener 46 extends through the sleeve 24. The fastener 46 is tightenable to engage the outer surface 42 of the pole 36 when the pole 36 is extended through the sleeve 24 for retaining the sleeve 24 at a selected point along the pole 36. The fastener 46 may comprise a screw or other type of threaded fastener 46 that can be tightened or loosened A seat mount 48 is positionable around the pole 36 such that the seat mount 48 is centrally positioned between the first bracket 12 and the second bracket 28 when each of the first bracket 12 and the second bracket 28 are positioned on the ladder 16. The seat mount 48 rests on the sleeve 24 when the pole 36 is extended through the sleeve 24 and the seat mount 48 to support the weight of a user. The seat mount 48 comprises a first tube 50, a second tube 52 and a third tube 54. The second tube 52 is coupled to the first tube 50 such that the second tube 52 forms an angle with the first tube 50. Moreover, the third tube 54 is coupled to and extends between each of the first tube 50 and the second tube 52 such that each of the first tube 50, the second tube 52 and the third tube 54 forms a respective side of a triangle. The pole 36 is extendable through the first tube 50 having the first tube 50 resting on the sleeve 24. Additionally, the second tube 52 extends along a horizontal line when the pole 36 is extended through the first tube 50 and the second tube 52 has a distal end 56 with respect to the first tube 50.

A seat unit 58 is removably attachable to the seat mount 48 and the user sits on the seat unit 58 while the user is on the ladder 16. In this way the seat unit 58 enhances comfort for the user while the user is on the ladder 16 for extended periods of time. The seat unit 58 comprises a first rod 60 that has a first end 62 and a second end 64. The distal end 56 of the second tube 52 insertably receives the first end 62 of the first rod 60. Additionally, the first rod 60 has a plurality of holes 66 extending therethrough and the holes 66 are spaced apart from each other and are distributed along the first rod 60.

The seat unit 58 includes a second rod 68 that is coupled to and is oriented perpendicular to the first rod 60. The second rod 68 is positioned adjacent to the second end 64 of the first rod 60. Moreover, the second rod 68 is vertically oriented when the first rod 60 is inserted into the second tube 52 and the second rod 68 has a distal end 70 with respect to the first rod 60. The seat unit 58 includes a seat 72 that is coupled to the distal end 70 of the second rod 68 and the user sits on the seat 72. The seat 72 has a nose 74 extending away from a rear portion 76 of the seat 72 such that the seat 72 has the shape of a bicycle saddle. Moreover, the nose 74 is directed toward the first tube 50 when the first rod 60 is inserted into the second tube 52.

A pin 78 is provided and the pin 78 is extendable through the second tube 52 to engage a respective one of the holes 66 in the first rod 60. In this way the seat 72 can be spaced a selected distance away from the first tube 50. The pin 78 is coupled to the second tube 52 with a chain, a cable or other type of flexible member to ensure the pin 78 does not get lost.

In use, the first bracket 12 is positioned on a respective step 14 on the ladder 16. The pole 36 is inserted through the first tube 50 and the sleeve 24 and the second bracket 28 is positioned on a respective step 14 on the ladder 16. The fastener 46 is tightened to inhibit the pole 36 from sliding in the sleeve 24. The first rod 60 of the seat unit 58 is inserted into the second tube 52 and the pin 78 is extended through a selected hole 66 in the first rod 60. Thus, the seat 72 is positioned to have the user sit thereon while the user is on the ladder 16. Additionally, each of the first bracket 12 and the second bracket 28 are positioned on steps 14 that facilitate the seat 72 to be positioned at a desired height on the ladder 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ladder seat assembly being configured to be mounted to a ladder thereby facilitating a user to be in a seated position while using the ladder, said assembly comprising:

a first bracket being positionable on a respective step of a ladder;

a sleeve being coupled to said first bracket;

a second bracket being positionable on a respective step of the ladder that is spaced upwardly on the ladder from the step on which said first bracket is positioned;

a pole being coupled to and extending downwardly from said second bracket, said pole being extendable through said sleeve when each of said first bracket and said second bracket are positioned on the respective steps of the ladder;

a fastener extending through said sleeve, said fastener being tightenable to engage an outer surface of said pole when said pole is extended through said sleeve for retaining said sleeve at a selected point along said pole;

a seat mount being positionable around said pole such that said seat mount is centrally positioned between said first bracket and said second bracket when each of said first bracket and said second bracket are positioned on the ladder, said seat mount resting on said sleeve when said pole is extended through said sleeve and said seat mount wherein said sleeve is configured to support the weight of a user; and a seat unit being removably attachable to said seat mount wherein said seat unit is configured to have the user sit thereon while the user is on the ladder thereby enhancing comfort for the user.

2. The assembly according to claim 1, wherein said first bracket has a central portion extending between a pair of end portions, each of said end portions extending downwardly from said central portion thereby defining a step space between said end portions, said step space insertably receiving the respective step having said central portion resting on the respective step.

3. The assembly according to claim 2, wherein said sleeve is positioned on an outer surface of a respective one of said end portions of said first bracket, said sleeve being centrally positioned on said respective end portion, said sleeve being oriented to extend along a vertical line when said first bracket is positioned on the respective step.

4. The assembly according to claim 1, wherein said second bracket has a central portion extending between a pair of end portions, each of said end portions of said second bracket extending downwardly from said central portion of said second bracket thereby defining a step space between said end portions of said second bracket, said step space associated with said second bracket insertably receiving the respective step on which said second bracket is positioned having said central portion of said second bracket resting on the respective step upon which said second bracket is positioned.

5. The assembly according to claim 4, wherein said pole has a top end, a bottom end and an outer surface extending therebetween, said outer surface of said pole being coupled to an outside surface of a respective one of said end portions of said second bracket, said top end of said pole being aligned with said central portion of said second bracket, said pole being centrally positioned on said second bracket, said sleeve insertably receiving said bottom end of said pole.

6. The assembly according to claim 5, wherein said seat mount comprises a first tube, a second tube and a third tube, said second tube being coupled to said first tube such that said second tube forms an angle with said first tube, said third tube being coupled to and extending between each of said first tube and said second tube such that each of said first tube, said second tube and said third tube forms a respective side of a triangle, said pole being extendable through said first tube having said first tube resting on said sleeve, said second tube having a distal end with respect to said first tube.

7. The assembly according to claim 6, wherein said seat unit comprises a first rod having a first end and a second end, said distal end of said second tube insertably receiving said first end of said first rod, said first rod having a plurality of holes extending therethrough, said holes being spaced apart from each other and being distributed along said first rod.

8. The assembly according to claim 7, further comprising a second rod being coupled to and being oriented perpendicular to said first rod, said second rod being positioned adjacent to said second end of said first rod, said second rod being vertically oriented when said first rod is inserted into said second tube, said second rod having a distal end with respect to said first rod.

9. The assembly according to claim 8, further comprising a seat being coupled to said distal end of said second rod wherein said seat is configured to have the user sit thereon, said seat having a nose extending away from a rear portion of said seat such that said seat has the shape of a bicycle saddle, said nose being directed toward said first tube when said first rod is inserted into said second tube.

10. The assembly according to claim 9, further comprising a pin being extendable through said second tube and engaging a respective one of said holes in said first rod for spacing said seat a selected distance away from said first tube.

11. A ladder seat assembly being configured to be mounted to a ladder thereby facilitating a user to be in a seated position while using the ladder, said assembly comprising:

a first bracket being positionable on a respective step of a ladder, said first bracket having a central portion extending between a pair of end portions, each of said end portions extending downwardly from said central portion thereby defining a step space between said end portions, said step space insertably receiving the respective step having said central portion resting on the respective step;

a sleeve being coupled to said first bracket, said sleeve being positioned on an outer surface of a respective one of said end portions of said first bracket, said sleeve being centrally positioned on said respective end portion, said sleeve being oriented to extend along a vertical line when said first bracket is positioned on the respective step;

a second bracket being positionable on a respective step of the ladder that is spaced upwardly on the ladder from the step on which said first bracket is positioned, said second bracket having a central portion extending between a pair of end portions, each of said end portions of said second bracket extending downwardly from said central portion of said second bracket thereby defining a step space between said end portions of said second bracket, said step space associated with said second bracket insertably receiving the respective step on which said second bracket is positioned having said central portion of said second bracket resting on the respective step upon which said second bracket is positioned;

a pole being coupled to and extending downwardly from said second bracket, said pole being extendable through said sleeve when each of said first bracket and said second bracket are positioned on the respective steps of the ladder, said pole having a top end, a bottom end and an outer surface extending therebetween, said outer surface of said pole being coupled to an outside surface of a respective one of said end portions of said second bracket, said top end of said pole being aligned with said central portion of said second bracket, said pole being centrally positioned on said second bracket, said sleeve insertably receiving said bottom end of said pole;

a fastener extending through said sleeve, said fastener being tightenable to engage said outer surface of said pole when said pole is extended through said sleeve for retaining said sleeve at a selected point along said pole;

a seat mount being positionable around said pole such that said seat mount is centrally positioned between said first bracket and said second bracket when each of said first bracket and said second bracket are positioned on the ladder, said seat mount resting on said sleeve when said pole is extended through said sleeve and said seat mount wherein said sleeve is configured to support the weight of a user, said seat mount comprising a first tube, a second tube and a third tube, said second tube being coupled to said first tube such that said second tube forms an angle with said first tube, said third tube being coupled to and extending between each of said first tube and said second tube such that each of said first tube, said second tube and said third tube forms a respective side of a triangle, said pole being extendable through said first tube having said first tube resting on said sleeve, said second tube having a distal end with respect to said first tube;

a seat unit being removably attachable to said seat mount wherein said seat unit is configured to have the user sit thereon while the user is on the ladder thereby enhancing comfort for the user, said seat unit comprising:

a first rod having a first end and a second end, said distal end of said second tube insertably receiving said first end of said first rod, said first rod having a plurality of holes extending therethrough, said holes being spaced apart from each other and being distributed along said first rod;

a second rod being coupled to and being oriented perpendicular to said first rod, said second rod being positioned adjacent to said second end of said first rod, said second rod being vertically oriented when said first rod is inserted into said second tube, said second rod having a distal end with respect to said first rod; and a seat being coupled to said distal end of said second rod wherein said seat is configured to have the user sit thereon, said seat having a nose extending away from a rear portion of said seat such that said seat has the shape of a bicycle saddle, said nose being directed toward said first tube when said first rod is inserted into said second tube; and a pin being extendable through said second tube and engaging a respective one of said holes in said first rod for spacing said seat a selected distance away from said first tube.

* * * * *